US011404827B2

(12) United States Patent
Son et al.

(10) Patent No.: US 11,404,827 B2
(45) Date of Patent: Aug. 2, 2022

(54) CONNECTOR LOCKING MECHANISM

(71) Applicant: J.S.T. Mfg. Co., Ltd., Tokyo (JP)

(72) Inventors: Tae-Ho Son, Gyeonggi-do (KR); Dong-Joo Kim, Gyeonggi-do (KR)

(73) Assignee: J.S.T. MFG. CO., LTD., Tokyo (JP)

( * ) Notice: Subject to any disclaimer, the term of this patent is extended or adjusted under 35 U.S.C. 154(b) by 0 days.

(21) Appl. No.: 17/147,979

(22) Filed: Jan. 13, 2021

(65) Prior Publication Data

US 2021/0249819 A1 Aug. 12, 2021

(30) Foreign Application Priority Data

Feb. 6, 2020 (JP) ..... JP2020-018646

(51) Int. Cl.
*H01R 13/641* (2006.01)
*H01R 13/627* (2006.01)
*H01R 13/639* (2006.01)

(52) U.S. Cl.
CPC ..... *H01R 13/641* (2013.01); *H01R 13/6272* (2013.01); *H01R 13/639* (2013.01)

(58) Field of Classification Search
CPC . H01R 13/641; H01R 13/6272; H01R 13/639
See application file for complete search history.

(56) References Cited

U.S. PATENT DOCUMENTS 5,628,648 A * 5/1997 Higgins, Jr. ..... H01R 13/641 439/489
9,054,459 B2 * 6/2015 Guillanton ..... H01R 13/642
9,666,989 B2 5/2017 Horiuchi
2018/0040976 A1 * 2/2018 Matsumoto ..... H01R 13/6275
2018/0040980 A1 * 2/2018 Matsumoto ..... H01R 13/631

FOREIGN PATENT DOCUMENTS

DE 10346916 B4 * 3/2008 ..... H01R 13/641
EP 1096616 A2 * 5/2001 ..... H01R 13/641
JP 6287987 B2 3/2018

* cited by examiner

*Primary Examiner* — Tho D Ta
(74) *Attorney, Agent, or Firm* — Kratz, Quintos & Hanson, LLP

(57) ABSTRACT

A connector locking mechanism includes a housing that includes an arm having a locking member for locking on one side and a working end on the other side and a CPA member, movably built in between a non-mating position and a complete mating position, having an arm pressing projection and an inclined surface. When mating, a mating connector is inserted into a mating opening, one side of the arm swivels on the leg portion as a fulcrum by the arm pressing projection to approach the mating connector, and the locking member is locked with the locking projection. When releasing mating, the CPA member is moved to the non-mating position, the inclined surface contacts the working end of the arm, the arm swivels moving away from the housing of the mating connector, and the locking member is released from the locking projection of the mating connector.

5 Claims, 17 Drawing Sheets

400
420
422
423
421
424
412
425
410
411
420
425
422
424
423
421

410
411
420
412
420

422
420
425
412

420
422
424
423
421
VIII F
VIII F
412
420
423
421
424

425
411
425

423
421
422
424
420
412
425
410
411

CONNECTOR LOCKING MECHANISM

BACKGROUND

Technical Field

The present invention relates to a connector locking mechanism for holding connecting parts together and preventing the connecting parts from falling off after connectors engage with each other.

Related Art

JP 6287987 B2 discloses a connector including a detection member that stays in a standby position until the male and female connector housings are fitted to each other and can move to the detection position when the male and female connector housings are fitted to each other normally. The detection member described above has an elastic arm that includes an engaging portion and an operating portion and can be tilted like a seesaw. At the detection position, the engaging portion is inserted into a concave portion formed on the sliding surface of the connector housing. As a result, the movement to the standby position is restricted, and when the operating portion is pressed, the detection member elastically displaces like a seesaw and the engaging portion comes out of the concave portion to return to the standby position.

SUMMARY

In the detection member described in JP 6287987 B2, in order to release the engagement between the male and female connector housings, it is required, after sliding the detection member in the mating direction, to push down the operating portion in the direction perpendicular to the mating direction.

Therefore, an object of the present invention is to provide a connector locking mechanism capable of releasing the engagement between male and female connector housings just by sliding the detection member toward the mating direction.

The present invention describes a connector locking mechanism including a housing that includes a mating opening that accepts a mating connector and an arm. The arm extends substantially parallel to an extending direction of the mating opening, the arm is connected via a leg portion of the arm as a fulcrum, the arm includes a locking member for locking capable of being locked with a locking projection of the mating connector on one side, and the arm includes a working end on another side. The connector locking mechanism also includes a locking member that is built in the housing movably between a non-mating position and a complete mating position and that includes an arm pressing projection provided at a position corresponding to the one side of the arm and an inclined surface at a position corresponding to the other side of the arm. When mating, the mating connector is inserted into the mating opening, the locking member is moved to the complete mating position by the mating connector, the one side of the arm swivels on the leg portion as the fulcrum so as to approach the mating connector by the arm pressing projection, and the locking member for locking is locked with the locking projection. When releasing mating, by moving the locking member toward the non-mating position, the inclined surface comes into contact with the working end of the arm so that the one side of the arm swivels on the leg portion as the fulcrum so as to move away from the housing of the mating connector, and the locking member for locking is released from the locking projection of the mating connector.

Also, in one aspect of the present invention, the connector locking mechanism further includes a slider and a spring member interposed between the slider and the locking member. The housing includes a locking projection for CPA locking. The locking member includes a CPA side locking projection that is locked with the locking projection for CPA locking when the locking member is located at the non-mating position. The slider includes a contact surface that is pressed against the mating connector and a pressing portion that presses the CPA side locking projection. When the mating connector is inserted into the mating opening, the mating connector presses the contact surface of the locking member located at the non-mating position so that the pressing portion presses the CPA locking projection, the locking projection for CPA locking is released from the CPA side locking projection, and the locking member is moved to the complete mating position by urging force of the spring member.

Also, in one aspect of the present invention, a plurality of the spring members is arranged in parallel between the slider and the locking member. The slider includes a plurality of spring receiving portions each accepting one end side of the plurality of spring members.

Also, in one aspect of the present invention, the locking member includes a base on which the inclined surface is formed, and the arm pressing projection extends from a central portion in a width direction orthogonal to the mating direction of the base to the mating direction.

Also, in one aspect of the present invention, the housing includes a rail that guides the locking member to move, and the base of the locking member moves on the rail between the non-mating position and the complete mating position.

According to the present invention, it is possible to provide the connector locking mechanism capable of releasing the engagement between the male and female connector housings simply by sliding the detection member in the mating direction.

According to one aspect of the present invention, when the connector is mated to the mating connector, the locking member is automatically moved from the non-mating position to the complete mating position by the urging force of the spring member so that it is possible to easily detect whether or not the "mating" of the connectors is completely finished.

According to one aspect of the present invention, even when the plurality of spring members is used, a structure of the connector locking mechanism can be simplified by using a single slider member, and can also be easily assembled.

According to one aspect of the present invention, the arm pressing projection can directly operate the locking member of the arm that is locked with the locking projection of the mating connector, and the connectors can surely be mated to each other and released from each other.

According to one aspect of the present invention, it is possible to limit a moving direction of the locking member only in the mating direction.

DETAILED DESCRIPTION

A connector locking mechanism according to an embodiment is described below with reference to the drawings. It should be noted that the embodiment described below describes an example of the connector locking mechanism in the present invention and that the present invention is not limited to the following embodiment of the connector locking mechanism and should be equally applied to the connector locking mechanism in other embodiments described in the claims. The connector locking mechanism described below is generally known as a connector position assurance mechanism (CPA mechanism), but the technical idea of the present invention is not limited to the CPA mechanism.

[Overall Configuration of Connector Locking Mechanism]

Figure 1:
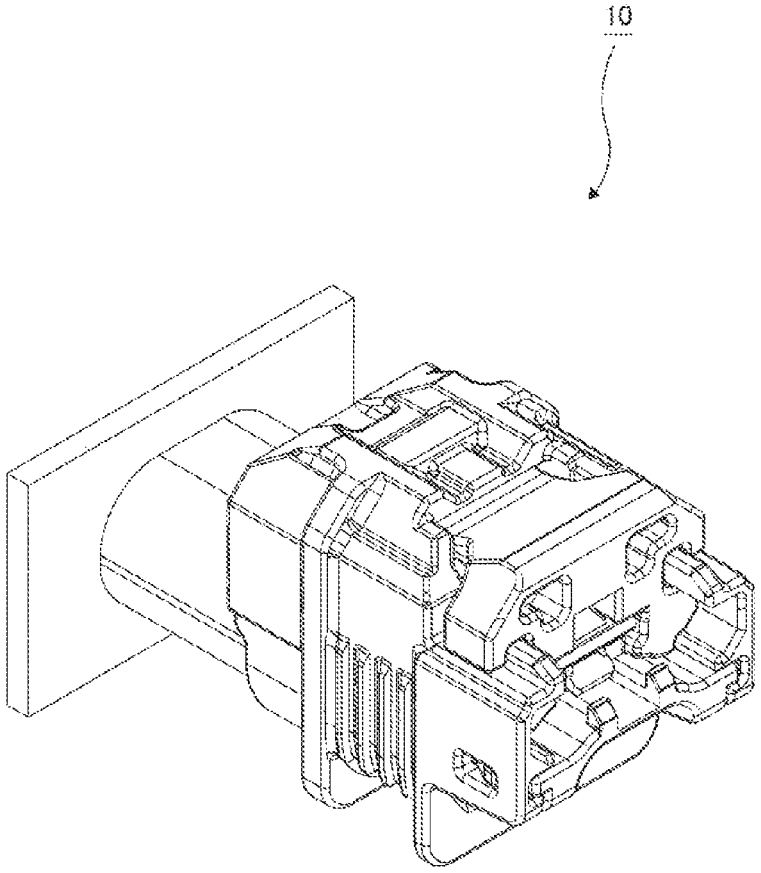
FIG. 1 is an external perspective view of a connector locking mechanism in a complete mating state according to an embodiment.

First, a connector locking mechanism 10 in the present embodiment will be described with reference to FIGS. 1 and 2. Note that FIG. 1 is an external perspective view of the connector locking mechanism 10 in a complete mating state in the present embodiment, and FIG. 2 is an exploded perspective view of the connector locking mechanism 10 in FIG. 1 when disassembled and viewed from an opposite side.

Figure 2:
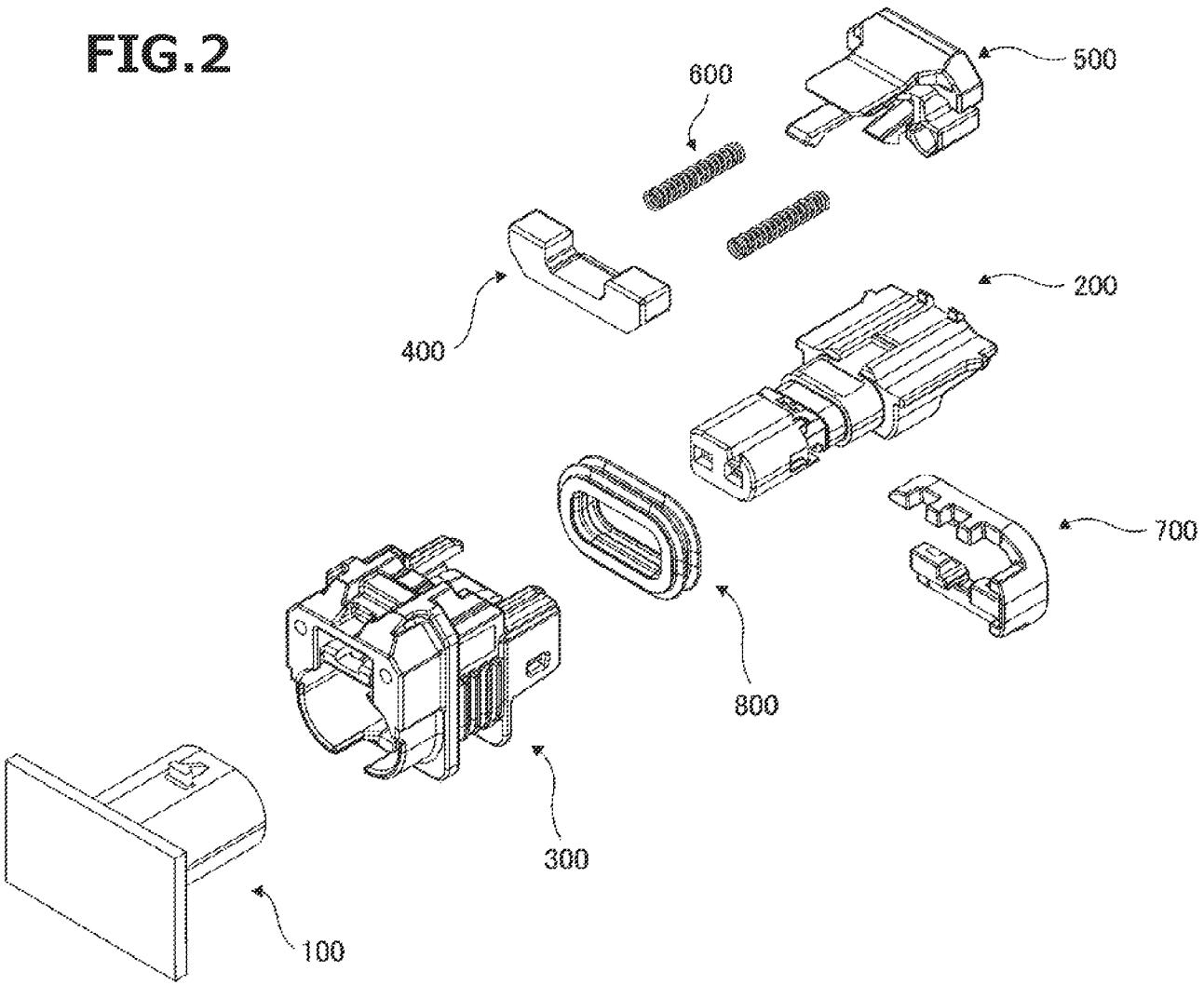
FIG. 2 is an exploded perspective view of the connector locking mechanism in FIG. 1 when disassembled and viewed from an opposite side.

As illustrated in FIG. 2, the connector locking mechanism 10 includes a male connector housing unit 100, a female connector housing 200, a hood housing 300, a slider 400, a CPA member 500, a spring member 600, a retainer 700, and a seal member 800. Note that a male connector terminal (not illustrated in the drawings) is mounted on the male connector housing unit 100 to constitute a male connector assembly. Also, the female connector housing 200, the hood housing 300, the slider 400, the CPA member 500, the spring member 600, the retainer 700, the seal member 800, and a female connector terminal (not illustrated in the drawings) are also assembled with each other to constitute a female connector assembly. The female connector assembly and the male connector assembly are to be mated with each other.

Note that, in the following description, a direction in which the male connector assembly and the female connector assembly are mated with each other is referred to as "a mating direction" or "a back-and-forth direction". In particular, a direction in Which the female connector assembly is mated into the male connector assembly, that is, a left direction of a paper surface in FIG. 2 is referred to as "front", and a direction in which the female connector assembly moves away from the male connector assembly, that is, a right direction of the paper surface in FIG. 2 is referred to as "rear". Also, a vertical direction in FIGS. 1 and 2 that is perpendicular to the mating direction is referred to as "an up-and-down direction". Further, a direction orthogonal to both the mating direction and the up-and-down direction is referred to as a "width direction".

[Male Connector Housing Unit 100]

Figure 3A:
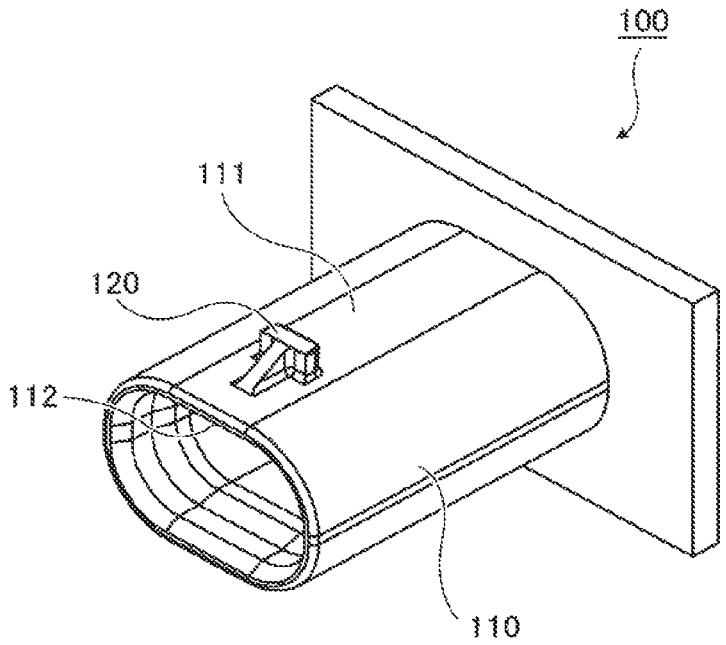
FIG. 3A is an external perspective view of a male connector housing unit.

Next, the male connector housing unit 100 will be described with reference to FIGS. 3A and 3B. Note that FIG.

Figure 3B:
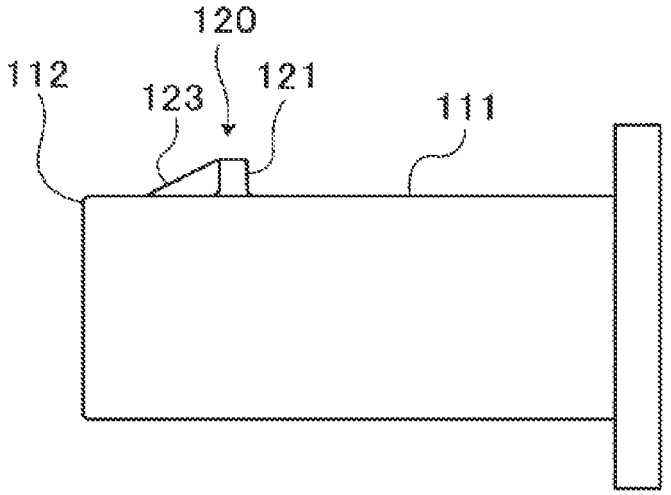
FIG. 3B is a side view of the male connector housing unit.

3A is an external perspective view of the male connector housing unit 100, and FIG. 3B is a side view of the male connector housing unit 100. The male connector housing unit 100 includes a male housing 110 and a male side locking projection 120 formed on an upper surface 111 of the male housing 110. The male housing 110 is elongated along the mating direction and has a hollow tubular shape. An inner shape of the male housing 110 is substantially the same as an outer shape of the female connector housing 200 described later, and the female connector housing 200 is inserted inside of the male housing 110 when the connectors are mated. A cross-sectional shape when cutting the male housing 110 in a plane perpendicular to the mating direction is a rounded rectangle in the present embodiment, but the cross-sectional shape may also be a circle, an ellipse, or a rectangle.

Inside the male housing 110, a male contact for making an electrical connection with a female contact mounted on the female connector housing 200, which will be described later, is arranged along the mating direction. The male housing 110 has an upper surface 111 and a rear end surface 112.

The male side locking projection 120 is formed on the upper surface 111 of the male housing 110 so as to project upward. The male side locking projection 120 includes a locking plate 121 that projects upward from the upper surface 111 of the male housing 110 so as to spread in a plane perpendicular to the mating direction and a inclined guide surface 123 inclined obliquely toward the upper end of the locking plate 121 from the upper surface 111 of the male housing 110. The rear end surface 112 abuts on the slider 400, which will be described later, and has a function of pressing and moving the slider 400 rearward.

[Female Connector Housing 200]

Figure 4A:
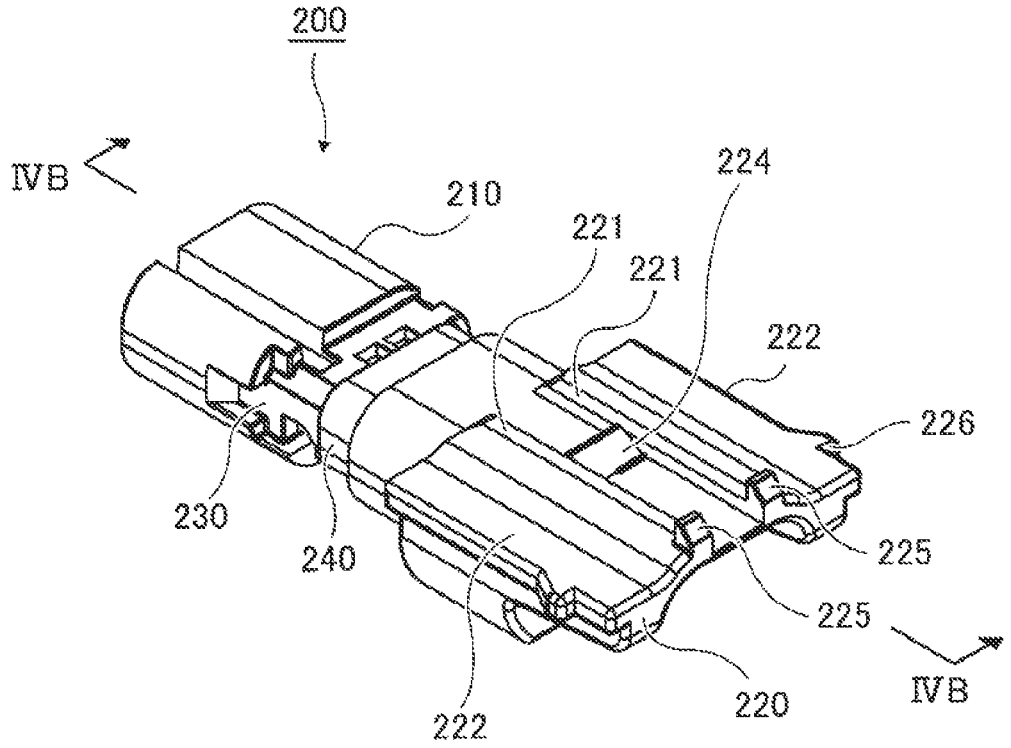
FIG. 4A is an external perspective view of a female connector housing.
Figure 4B:
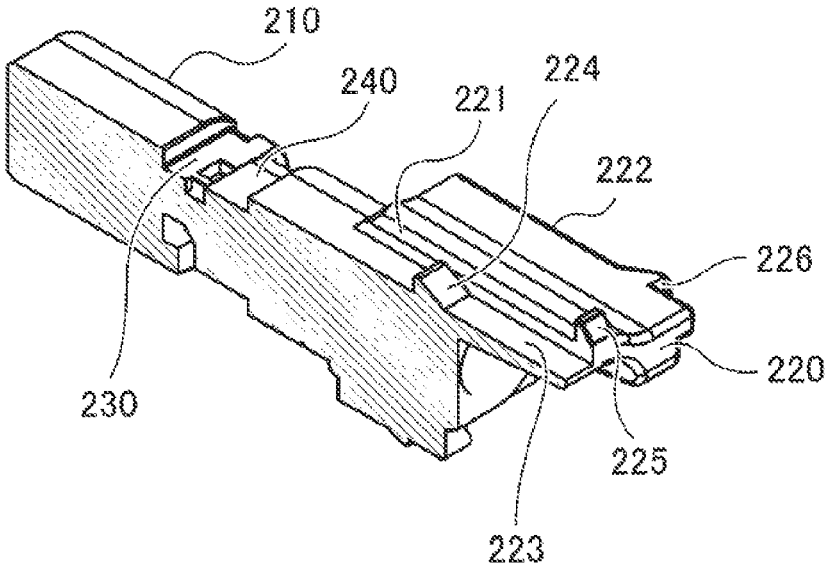
FIG. 4B is a cross-sectional perspective view of the female connector housing when cut along line IVB-IVB in FIG. 4A.
Figure 5A:
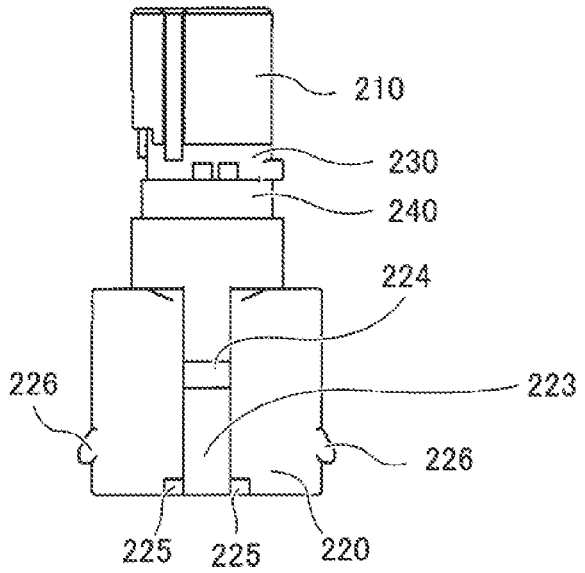
FIG. 5A is a top view of the female connector housing.
Figure 5B:
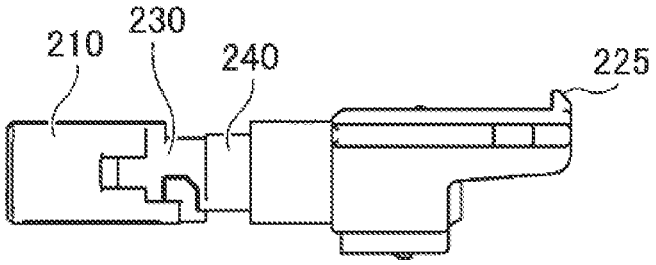
FIG. 5B is a right side view of the female connector housing.
Figure 5C:
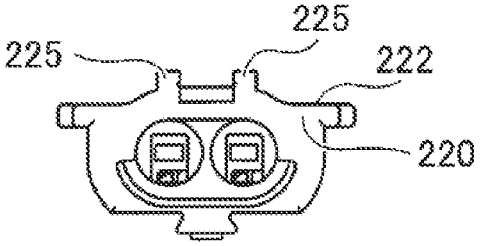
FIG. 5C is a rear view of the female connector housing.
Figure 5D:
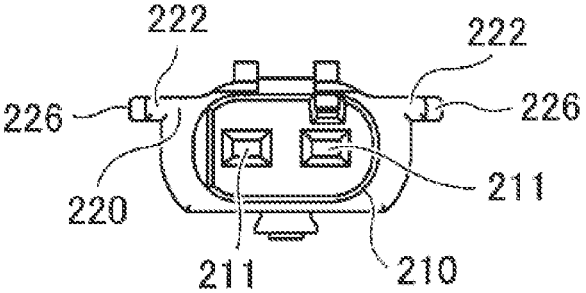
FIG. 5D is a front view of the female connector housing.

Next, the female connector housing 200 will be described with reference to FIGS. 4A, 4B, and 5A to 5D. Note that FIG. 4A is an external perspective view of a female connector housing 200, and FIG. 4B is a cross-sectional perspective view of the female connector housing when cut along line IVB-IVB in FIG. 4A. Also, FIG. 5A is a top view of the female connector housing 200, FIG. 5B is a right side view of the female connector housing 200, FIG. 5C is a rear view of the female connector housing 200, and FIG. 5D is a front view of the female connector housing 200. The female connector housing 200 includes a tubular body portion 210, a table portion 220, a retainer mounting groove 230, and a seal mourning groove 240. The tubular body portion 210 is elongated along the mating direction, and the outer shape of the tubular body portion 210 is substantially the same as the inner shape of the male housing 110. A cross-sectional shape when cutting the tubular body portion 210 in a plane perpendicular to the mating direction is a rounded rectangle, but the cross-sectional shape may also be a circle, an ellipse, or a rectangle as with the male housing 110. A terminal accommodating port 211 penetrating inside in the back-and-forth direction is formed on the tubular body portion 210 to accommodate a female connector terminal (not illustrated in the drawings).

The table portion 220 is a member formed in a flat plate shape with an extension in the width direction on the upper side of the tubular body portion 210. On the table portion 220, two rails 221 formed along the mating direction for guiding the movement of the CPA member 500 in the back-and-forth direction, a flat plate-shaped expansion portion 222 projecting outward in the width direction wider than the tubular body portion 210 on the outer side of the rail 221 in the width direction, an inter-rail groove 223 formed between the two rails 221, a female side locking projection 224 formed on the inter-rail groove 223 so as to project upward, and a stopper 225 formed at the rear end of the rail 221 so as to project upward are provided. A housing lock 226 projects laterally at the rear of the expansion portion 222.

The retainer mounting groove 230 is formed on the front side of the tubular body portion 210 compared to the table portion 220 and has a groove shape in which the outer shape of the tubular body portion 210 is slightly reduced, and a retainer described later is mounted on the retainer mounting groove 230. Also, the seal mounting groove 240 is formed on the rear side of the retainer mounting groove 230, and a seal member described later is mounted on the seal mounting groove 240.

[Hood Housing 300]

Figure 6A:
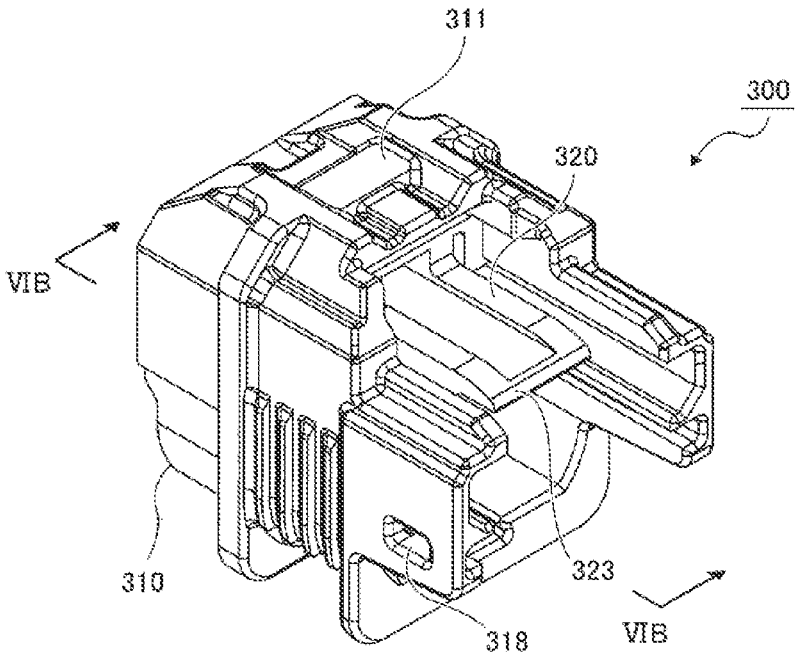
FIG. 6A is an external perspective view of a hood housing.
Figure 6B:
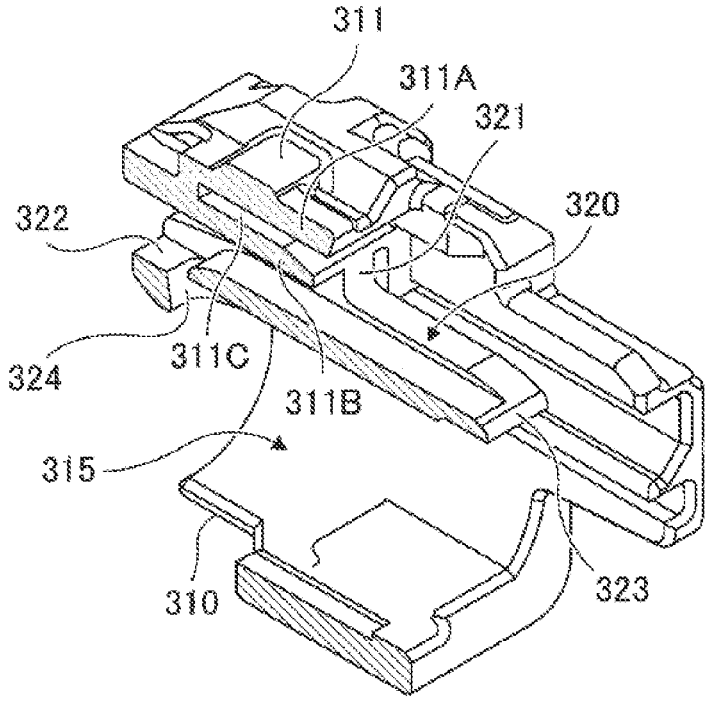
FIG. 6B is a cross-sectional perspective view of the hood housing when cut along line VIB-VIB in FIG. 6A.
Figure 7A:
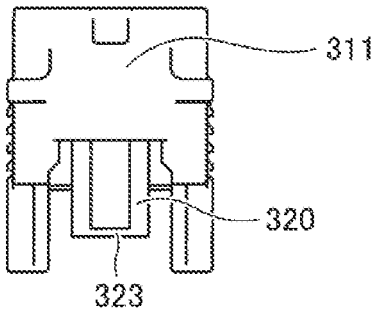
FIG. 7A is a top view of the hood housing.
Figure 7B:
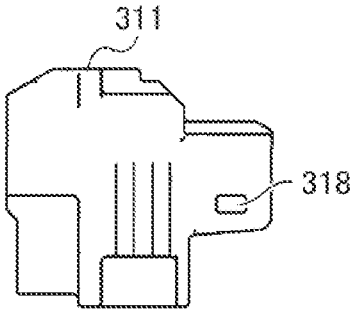
FIG. 7B is a right side view of the hood housing.
Figure 7C:
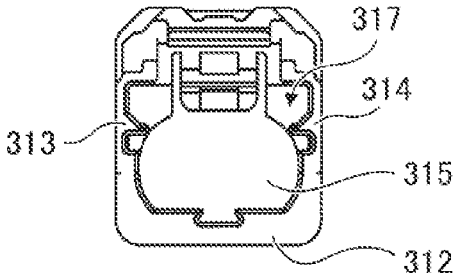
FIG. 7C is a rear view of the hood housing.
Figure 7D:
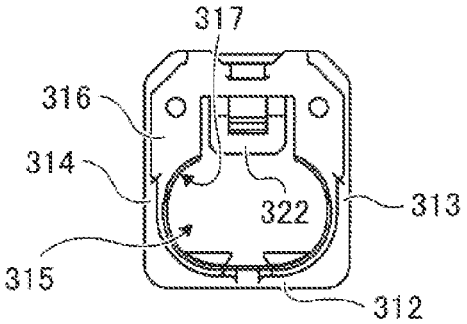
FIG. 7D is a front view of the hood housing.

A hood housing 300 will be described with reference to FIGS. 6A, 6B, and 7A to 7D. FIG. 6A is an external perspective view of the hood housing 300, and FIG. 6B is a cross-sectional perspective view of the hood housing 300 when cut along line VIB-VIB in FIG. 6A. Also, FIG. 7A is a top view of the hood housing 300, FIG. 7B is a right side view of the hood housing 300, FIG. 7C is a rear view of the hood housing 300, and FIG. 7D is a front view of the hood housing 300. The hood housing 300 is composed of a hood body 310 and an arm 320. The hood body 310 is basically a tubular member extending along the mating direction, includes a hood upper plate 311, a hood lower plate 312, a hood right side plate 313, and a hood left side plate 314, and has connector accommodating space 315 inside. A hood front wall 316 is formed among the hood upper plate 311, the hood right side plate 313, and the hood left side plate 314.

The rear of the hood front wall 316 continues through the connector accommodating space 315 and serves as a slider accommodating portion 317. The female connector housing 200 and the male connector housing unit 100 mated to the female connector housing 200 described above are accommodated in the connector accommodating space 315 and the slider accommodating portion 317. A housing lock opening 318 is provided at the rear of each of the hood right side plate 313 and the hood left side plate 314. The housing lock opening 318 is for accepting the housing lock 226 described above and making the housing lock 226 described above being engaged when the female connector housing 200 is mounted on the hood housing 300.

The hood upper plate 311 is divided in the up-and-down direction on the rear side to form a first upper plate 311A and a second upper plate 311B. The first upper plate 311A and the second upper plate 311B are separated from each other by an upper plate inner slot 311C formed horizontally along the back-and-forth direction. The upper plate inner slot 311C accepts a guiding plate 430 of the slider 400 described later.

The arm 320 includes a leg portion 321 continuous with the rear end portion of the second upper plate 311B and hanging down from the rear end portion of the second upper plate 311B, a front end portion 322 extending forward from the leg portion 321, and a working end 323 extending rearward from the leg portion 321. With the structure described above, the arm 320 is connected to the hood upper plate 311 with the leg portion 321 as a fulcrum and capable of swiveling.

On the lower surface side of the front end portion 322, a locking step 324 for locking that is retracted upward is formed at a portion slightly displaced from the front end to the rear side. The locking step 324 can be locked with the male side locking projection 120 of the male connector housing unit 100 that constitutes the mating connector when completely mated. The working end 323 extends rearward than the hood upper plate 311 and causes the arm 320 to swivel in cooperation with an inclined surface of a CPA member 500 described later.

[Slider 400]

Figures 8A, 8B, 8C, 8D, 8E, 8F:
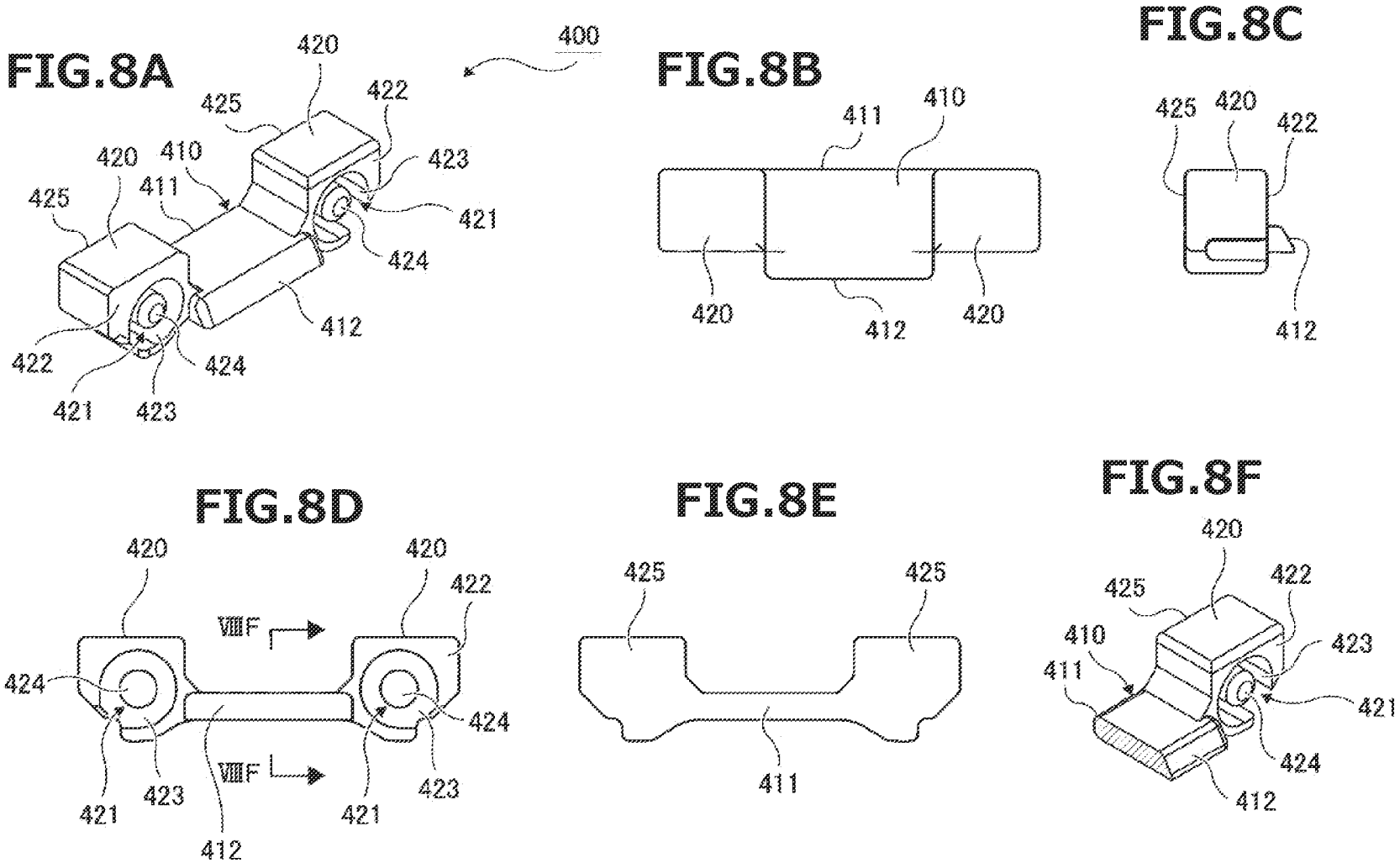
FIG. 8A is an external perspective view of a slider.
FIG. 8B is a top view of the slider.
FIG. 8C is a right side view of the slider.
FIG. 8D is a rear view of the slider.
FIG. 8E is a front view of the slider.
FIG. 8F is a cross-sectional perspective view of the slider when cut along line VIIIF-VIIIF in FIG. 8D.

The slider 400 will be described with reference to FIGS. 8A to 8F. Note that, FIG. 8A is an external perspective view of the slider 400, FIG. 8B is a top view of the slider 400, FIG. 8C is a right side view of the slider 400, FIG. 8D is a rear view of the slider 400, FIG. 8E is a front view of the slider 400, and FIG. 8F is a cross-sectional perspective view of the slider 400 when cut along line VIIIF-VIIIF in FIG. 8D. The slider 400 includes a slider body 410 and two spring receiving units 420. The slider 400 is a plate-shaped member having a predetermined plate thickness in the up-and-down direction, a predetermined length in the back-and-forth direction, and a predetermined width in the width direction. The slider 400 includes a contact surface 411 pressed against the rear end surface 112 of the male connector housing unit 100 constituting the mating connector on the front surface side and a pressing surface 412 that presses a CPA side locking projection of a CPA member 500 described later on the rear surface side.

The spring receiving unit 420 is a block-shaped member formed on both outer sides of the slider body 410 in the width direction, and each includes a slider side spring receiving portion 421. The slider side spring receiving portion 421 is, while being open on the rear side in the back-and-forth direction, closed on the front side. The slider side spring receiving portion 421 is composed of an opening 423 being annular formed toward the front from a rear surface 422 of the spring receiving unit 420 and a spring supporting projection 424 that projects rearward from the bottom portion of the opening 423, and the slider side spring receiving portion 421 accepts and supports the front end portion of the spring member 600 described later. The front side of the spring receiving unit 420 is a front surface 425.

[CPA Member 500]

Figure 9A:
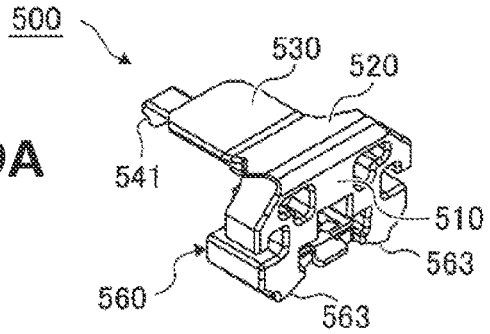
FIG. 9A is an external perspective view of a CPA member.
Figure 9B:
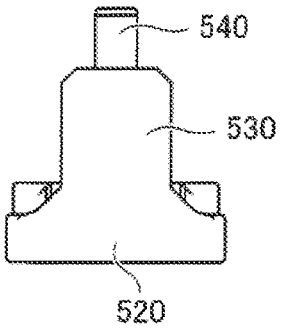
FIG. 9B is a top view of the CPA member.
Figure 9C:
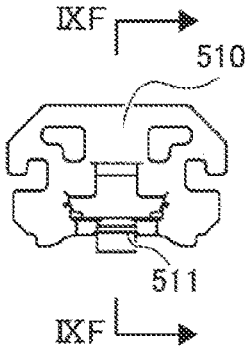
FIG. 9C is a rear view of the CPA member.
Figure 9D:
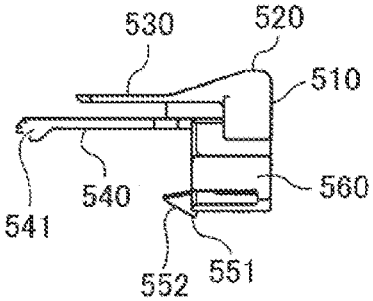
FIG. 9D is a right side view of the CPA member, FIG. 9E Is a front view of the CPA member.
Figure 9E:
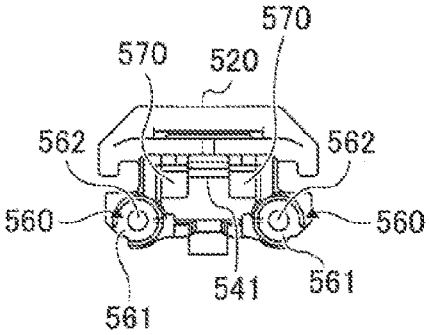
FIG. 9F is a cross-sectional perspective view of the CPA member when cut along line IXF-IXF in FIG. 9C.
FIG. 9G is a cross-sectional view of the CPA member along line IXF-IXF when cut along line IXF-IXF in FIG. 9C.
Figure 9F:
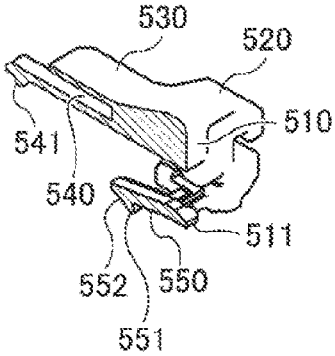
Figure 9G:
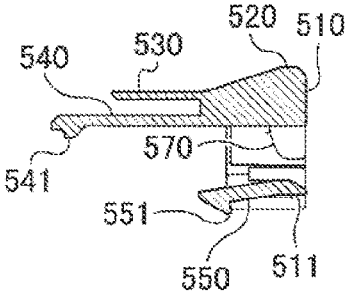

The CPA member 500 as a locking member of the present invention will be described with reference to FIGS. 9A to 9G. Note that, FIG. 9A is an external perspective view of a CPA member 500, FIG. 9B is a top view of the CPA member 500, FIG. 9C is a rear view of the CPA member 500, FIG. 9D is a right side view of the CPA member 500, FIG. 9E is a front view of the CPA member 500, FIG. 9F is a cross-sectional perspective view of the CPA member 500 when cut along line IXF-IXF in FIG. 9C, and FIG. 9G is a cross-sectional view of the CPA member 500 along line IXF-IXF when cut along line IXF-IXF in FIG. 9C. The CPA member 500 is a member that is built in the female connector housing 200 and the hood housing 300 movably between the non-mating position and the complete mating position. The CPA member 500 includes a base 510 extending in the up-and-down direction and the width direction, an operation button 520, a guiding plate 530, an upper side extension plate 540, a lower side extension plate 550, a CPA side spring receiving portion 560, and an inclined surface 570.

The base 510 has a base bottom surface 511. The operation button 520 is formed in a raised shape at the top of the base 510, and it is possible to perform a pressing operation on the operation button 520 with fingers easily. The guiding plate 530 extends forward from the front end portion of the operation button 520 and is slightly wider in the width direction. At the time of assembly, the guiding plate 530 is inserted sliding-movably into the upper plate inner slot 311C between the first upper plate 311A and the second upper plate 311B of the hood housing 300 described above.

The upper side extension plate 540 is a slightly narrow member that extends forward, below the guiding plate 530, from the central portion of the front end of the operation button 520, that is, from the central portion in the width direction of the base 510. The upper side extension plate 540 is narrower than the guiding plate 530 and extends forward longer than the guiding plate 530. At the tip of the upper side extension plate 540, an arm pressing projection 541 projecting downward is formed. The arm pressing projection 541 is provided so as to be located at a position corresponding to the upper side of the front end portion 322 of the arm 320 of the hood housing 300 when the CPA member 500 is built in the female connector housing 200 and the hood housing 300.

The lower side extension plate 550 is a slightly narrow member extending forward from the lower center of the base 510. The lower side extension plate 550 is shorter than the guiding plate 530 and the upper side extension plate 540. A CPA side locking projection 551 projecting downward is formed at the tip of the lower side extension plate 550. The front surface of the CPA side locking projection 515 is a locking projection slope 552 that recedes downward from the tip and reaches the lower end, on which the pressing surface 412 of the slider 400 abuts.

The CPA side spring receiving portion 560 is a slightly elongated tubular member formed on both sides of the lower side extension plate 550 in the width direction, and the inner portion of the CPA side spring receiving portion 560 in the width direction is connected to the base 510. The CPA side spring receiving portion 560 is, while being open on the front in the back-and-forth direction, closed on the rear side. The CPA side spring receiving portion 560 is composed of an opening 561 being annular formed toward the rear and a spring supporting projection 562 that projects forward from the bottom portion of the opening 561, and the CPA side spring receiving portion 560 supports the rear end portion of the spring member 600, which will be described later. Also, the CPA side spring receiving portion 560 includes a spring receiving portion bottom surface 563.

The inclined surface 570 is formed on both sides in the width direction of the base portion of the upper side extension plate 540, that is, on both lower sides of the base 510. The inclined surface 570 is inclined rearward as going downward and comes into contact with the working end 323 of the arm 320 described above. The inclined surface 570 is provided so as to be located at a position corresponding to the working end 323 of the arm 320 of the hood housing 300 when the CPA member 500 is built in the female connector housing 200 and the hood housing 300.

Figure 10A:
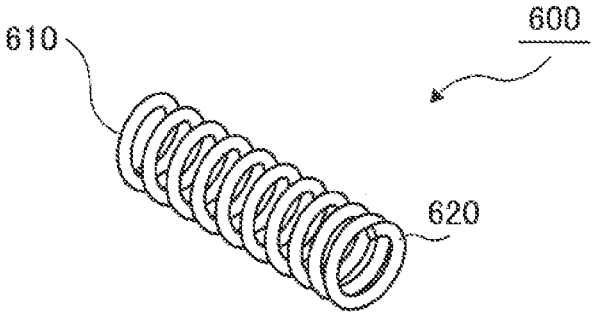
FIG. 10A is an external perspective view of a spring member.
Figure 10B:
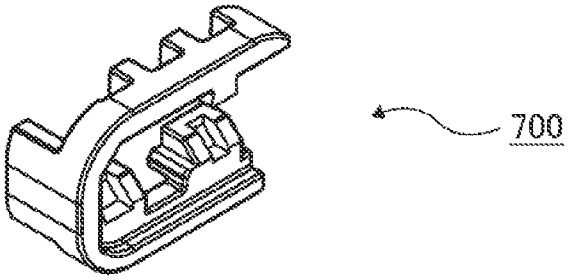
FIG. 10B is an external perspective view of a retainer.
Figure 10C:
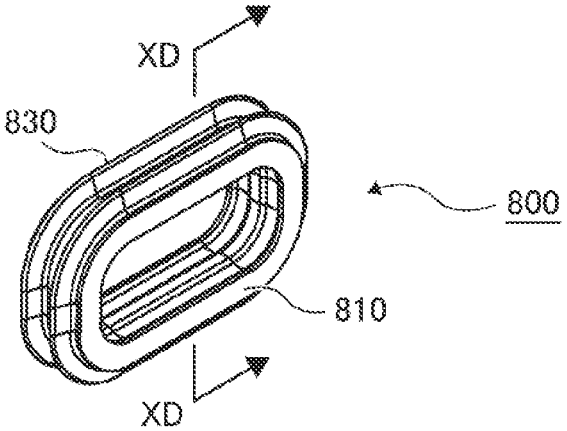
FIG. 10C is an external perspective view of a seal member.
Figure 10D:
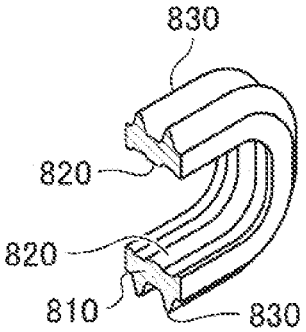
FIG. 10D is a cross-sectional perspective view of the seal member in FIG. 10C when cut along line XD-XD.

Next, the spring member 600, the retainer 700, and the seal member 800 will be described with reference to FIGS. 10A to 10D. Note that FIG. 10A is an external perspective view of the spring member 600. FIG. 10B is an external perspective view of the retainer 700. FIG. 10C is an external perspective view of the seal member 800, and FIG. 10D is a cross-sectional perspective view of the seal member 800 in FIG. 10C when cut along line XD-XD.

[Spring Member 600]

The spring member 600 is a member interposed between the slider 400 and the CPA member 500 described above. The spring member 600 winds around an axis in the mating direction, takes a form of a coil spring elongated in the back-and-forth direction, and includes a front end 610 and a rear end 620. Note that, in the present embodiment, two spring members 600 are arranged in parallel between the slider 400 and the CPA member 500, but the present invention is not limited to two spring members 600, that is, one spring member 600 may be arranged, and three or more spring members may also be arranged. In that case, the slider 400 and the CPA member 500 may be provided with the spring receiving portions corresponding to the number of spring members 600, respectively.

[Retainer 700]

The retainer 700 has a substantially C-shaped outer shape and has a shape that can be mounted on the retainer mounting groove 230 of the female connector housing 200 described above from one lateral side in the width direction. After temporarily mounting the retainer 700 on the retainer mounting groove 230 of the female connector housing 200, the female connector terminal is inserted into the terminal accommodating port 211, and then the retainer 700 is moved toward the other side (the opposite lateral side) in the width direction to reach the final locked state. Accordingly, the retainer 700 can lock the female connector terminal so that the female connector terminal cannot be pulled out from the terminal accommodating port 211. Also, when the retainer 700 is in the final locked state, the outer surface of the retainer 700 is made continuous with no step with respect to the outer shape of the tubular body portion 210 of the female connector housing 200.

[Seal Member 800]

The seal member 800 is made of rubber or resin and has a ring shape corresponding to the shape of the seal mounting groove 240 of the female connector housing 200 described above. The seal member 800 includes a seal body 810 being annular, a plurality of inner seal ridges 820 formed on the inner surface of the seal body 810, and a plurality of outer seal ridges 830 formed on the outer surface of the seal body 810. The inner seal ridge 820 functions to hold the seal member 800 in the seal mounting groove 240 when the seal member 800 is mounted on the seal mounting groove 240. Also, the outer seal ridge 830 is in close contact with the inner surface of the male housing 110 when the male connector housing unit 100 is mated to the female connector housing 200 and exerts a waterproof effect.

[Assembly of Female Connector Assembly]

Next, the assembly of the female connector assembly will be described. First, the retainer 700 is mounted on the retainer mounting groove 230 of the female connector housing 200 from one side in the width direction to temporarily mount the retainer 700. Next, the seal member 800 is mounted on the seal mounting groove 240.

Next, the slider 400, the spring member 600, and the CPA member 500 are inserted from the rear side into the upper part of the connector accommodating space 315 of the hood housing 300, and at the same time, the female connector housing 200 on which the retainer 700 and the seal member 800 are mounted is inserted from the rear side into the lower part of the connector accommodating space 315. At this time, a mating opening that accepts the male housing 110 of the male connector housing unit 100 is formed between the tubular body portion 210 of the female connector housing 200 and the hood lower plate 312, the hood right side plate 313, and the hood left side plate 314 of the hood housing 300.

At this time, the housing locks 226 formed at the rear of the table portion 220 of the female connector housing 200 engage with the housing lock openings 318 formed in the hood right side plate 313 and the hood left side plate 314 of the hood housing 300, respectively. As a result, the female connector housing 200 and the hood housing 300 are fixed to each other. Also, the slider 400 is accommodated so that the front surface 425 of the spring receiving unit 420 of the slider 400 faces the slider accommodating portion 317 formed on the rear side of the hood front wall 316 of the hood housing 300 and the spring supporting projection 424 of the slider side spring receiving portion 421 faces the rear.

Also, the front end 610 of the each spring member 600 is inserted into the opening 423 of the slider side spring receiving portion 421 of the slider 400 and is supported by the spring supporting projection 424. The rear end 620 of the each spring member 600 is inserted into the opening 561 of the CPA side spring receiving portion 560 of the CPA member 500 and is supported by the spring supporting projection 562.

Further, at this time, the guiding plate 530 of the CPA member 500 is inserted into the upper plate inner slot 311C formed between the first upper plate 311A and the second upper plate 311B of the hood housing 300 so that the movement of the guiding plate 530 in the up-and-down direction is restricted. At the same time, as the spring member 600 is compressed or the spring member 600 extends, the guiding plate 530 can move in the back-and-forth direction with respect to the hood housing 300.

Also, at this time, the upper side extension plate 540 of the CPA member 500 is located above the front end portion 322 of the arm 320 of the hood housing 300, and, on the other hand, the inclined surface 570 of the CPA member 500 is located above or rearward the working end 323 of the arm 320 of the hood housing 300.

Further, the base bottom surface 511 of the base 510 of the CPA member 500 and the spring receiving portion bottom surface 563 of the CPA side spring receiving portion 560 are placed on the female connector housing 200. At this time, the base bottom surface 511 of the CPA member 500 is mounted on the inter-rail groove 223 of the female connector housing 200, and the spring receiving portion bottom surface 563 is mounted on the expansion portion 222 of the table portion 220 of the female connector housing 200. As a result, the CPA member 500 can move sliding in the back-and-forth direction along the rail 221 of the female connector housing 200.

In addition, the slider 400 can also be moved in the back-and-forth direction above the tubular body portion 210 of the female connector housing 200, but when the slider 400 moves rearward, the slider body 410 of the slider 400 moves sliding on the inter-rail groove 223 of the female connector housing 200, and the unit bottom surface 426 of the spring receiving unit 420 of the slider 400 moves sliding on the expansion portion 222 of the table portion 220 of the female connector housing 200.

[Operation when Mating]

Figure 11A:
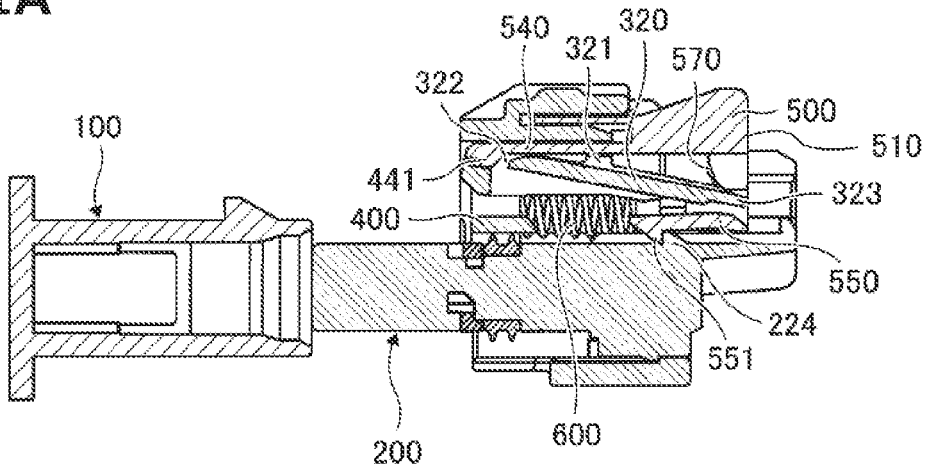
FIG. 11A is a cross-sectional view illustrating a male connector assembly and a female connector assembly in a non-mating state.
Figure 11B:
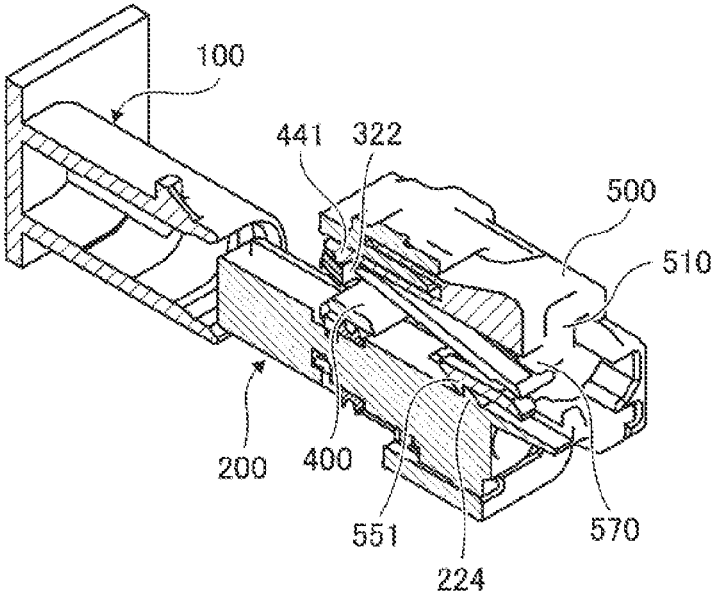
FIG. 11B is a cross-sectional perspective view corresponding to FIG. 11A.

Next, the operation of the connector locking mechanism in the present embodiment will be described. As illustrated in FIGS. 11A and 11B, in the non-mating state before the male connector housing unit 100 is mated to the female connector housing 200, the CPA member 500 is located at the non-mating position with respect to the female connector housing 200 and the hood housing 300. At this time, the CPA side locking projection 551 of the lower side extension plate 550 of the CPA member 500 is locked with the female side locking projection 224 of the female connector housing 200, and the CPA member 500 is locked immovably rearward with respect to the female connector housing 200.

Also, at this time, the slider 400 is in the front position on the female connector housing 200, and therefore the spring member 600 is in the extended state. Further, the inclined surface 570 of the base 510 of the CPA member 500 contacts and acts on the working end 323 of the arm 320 of the hood housing 300, swiveling the working end 323 of the arm 320 downward and the front end portion 322 of the arm 320 upward on the leg portion 321 as the fulcrum. At this time, the upper side extension plate 540 of the CPA member 500 extends forward above the arm 320, and the arm pressing projection 441 is located above the front end portion 322 of the arm 320.

Figure 12A:
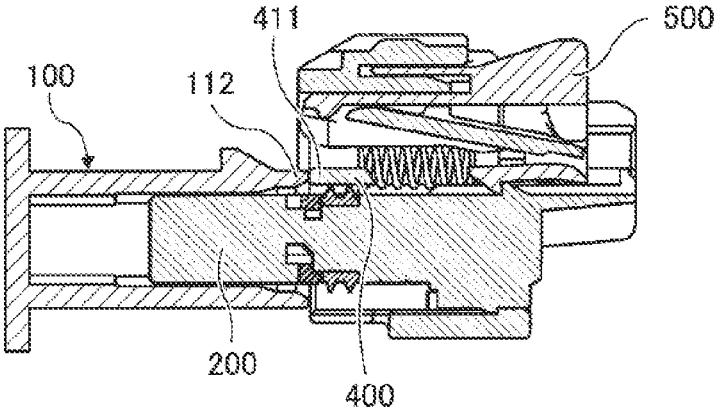
FIG. 12A is a cross-sectional view illustrating a state in which the female connector housing is inserted into the male connector housing unit and a rear end surface of the male housing abuts on the slider, and FIG. 12B Is a cross-sectional perspective view corresponding to FIG. 12A.
Figure 12B:
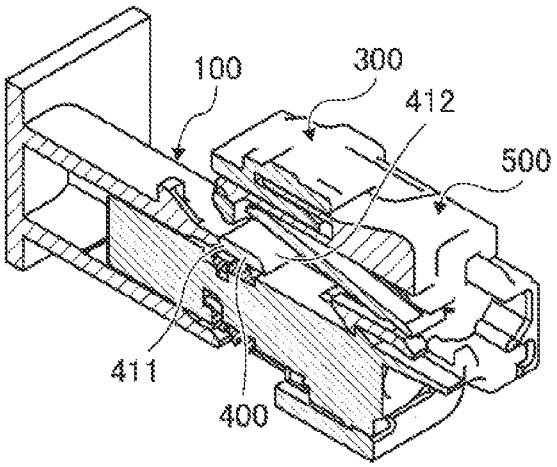

Next, as illustrated in FIGS. 12A and 12B, the female connector housing 200 is inserted into the male connector housing unit 100, and the male connector housing unit 100 is moved rearward (in the mating direction) with respect to the female connector housing 200. Then, the rear end surface 112 of the male housing 110 abuts on the contact surface 411 of the slider 400 to start pushing the slider 400 rearward. Since the CPA member 500 is immovable with respect to the female connector housing 200, the spring member 600 starts being compressed between the slider side spring receiving portion 421 of the slider 400 and the CPA side spring receiving portion 560 of the CPA member 500.

Figure 13A:
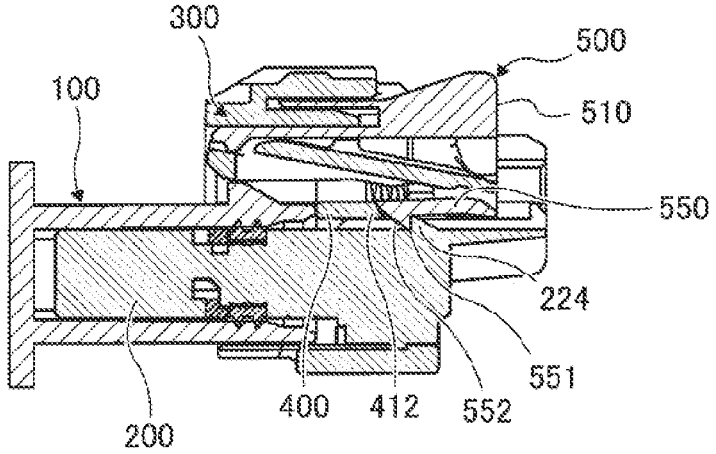
FIG. 13A is a cross-sectional view illustrating a state in which the female connector housing is further inserted into the male connector housing unit from the state in FIG. 12A and the slider is in contact with the locking projection of the CPA member.
Figure 13B:
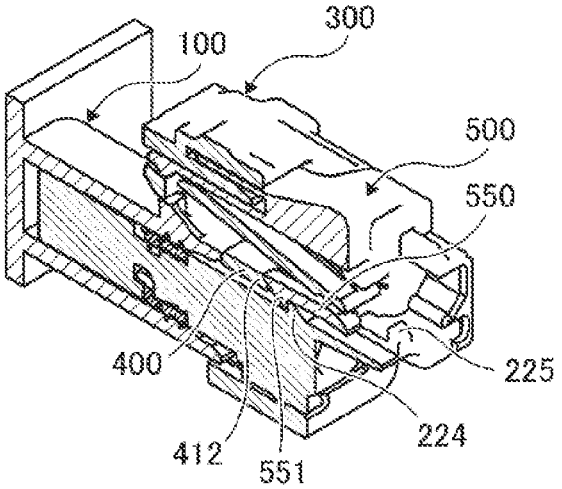
FIG. 13B is a cross-sectional perspective view corresponding to FIG. 13A.
Figure 14A:
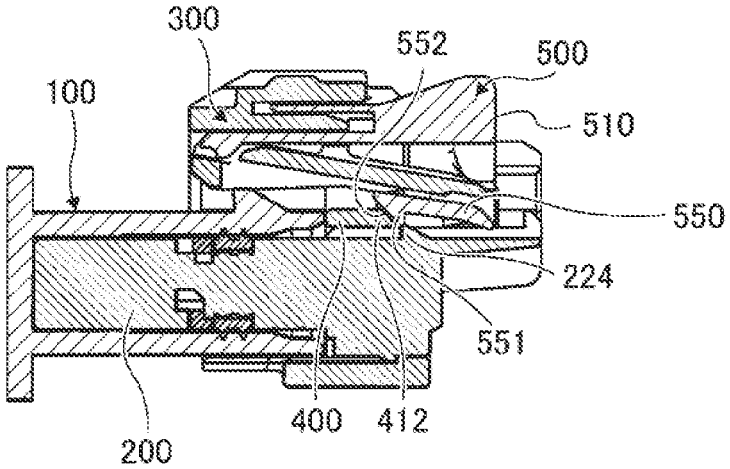
FIG. 14A is a cross-sectional view illustrating a state in which the female connector housing is further inserted into the male connector housing unit from the state in FIG. 13A and the slider pushes up the locking projection of the CPA member.
Figure 14B:
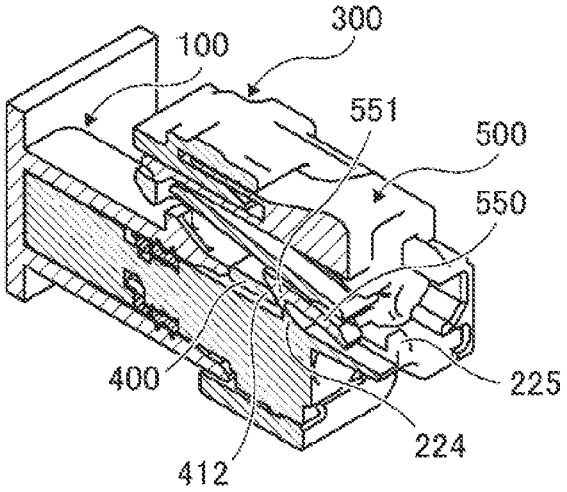
FIG. 14B is a cross-sectional perspective view corresponding to FIG. 14A.

When the male housing 110 is further moved rearward, as illustrated in FIGS. 13A and 13B, the pressing surface 412 of the slider 400 makes contact with the locking projection slope 552 of the CPA side locking projection 551 of the CPA member 500. Next, as illustrated in FIGS. 14A and 14B, the inclined surface of the pressing surface 412 of the slider 400 and the locking projection slope 552 of the CPA side locking projection 551 interact with each other to act an upward force on the CPA side locking projection 551 and deform the lower side extension plate 550 upward using the base portion of the lower side extension plate 550 connecting with the base 510 as the fulcrum, resulting in releasing locking between the CPA side locking projection 551 and the female side locking projection 224. At this time, the male side locking projection 120 of the male housing 110 is located below the locking step 324 of the front end portion 322 of the arm 320 of the hood housing 300.

When locking between the CPA side locking projection 551 and the female side locking projection 224 is released, the spring force accumulated in the spring member 600 is released and the spring member 600 extends rearward. As a result, the CPA member 500 is moved rearward. At this time, the base bottom surface 511 of the CPA member 500 moves sliding on the inter-rail groove 223 of the female connector housing 200, and the spring receiving portion bottom surface 563 of the CPA side spring receiving portion 560 moves sliding on the rail 221 and the expansion portion 222 outside the rail 221. Regarding the rearward movement of the CPA member 500, the rear surface of the base 510 is limited by the stopper 225 provided on the rail 221 of the female connector housing 200 to prevent the CPA member 500 from falling out of the female connector housing 200.

Also, when the CPA member 500 moves rearward with respect to the female connector housing 200 and the hood housing 300, the inclined surface 570 provided on the base 510 of the CPA member 500 moves away from the working end 323 of the arm 320 of the hood housing 300. At the same time, the upper side extension plate 540 of the CPA member 500 moves rearward above the arm 320, and the arm pressing projection 541 pushes the front end portion 322 of the arm 320 downward. That is, the arm 320 swivels counterclockwise on the leg portion 321 as the fulcrum, the locking step 324 of the front end portion 322 of the arm 320 is locked with the male side locking projection 120 of the male housing 110, and the connector is in the mating state.

[Operation when Releasing Mating]

Figure 15A:
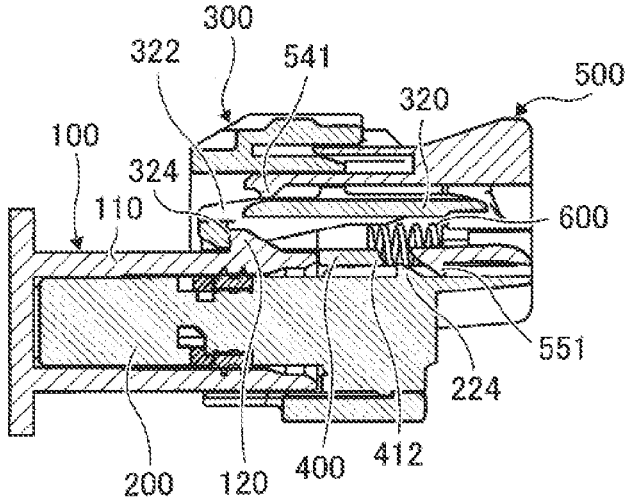
FIG. 15A is a cross-sectional view illustrating a state of the male connector assembly and the female connector assembly in the complete mating state.
Figure 15B:
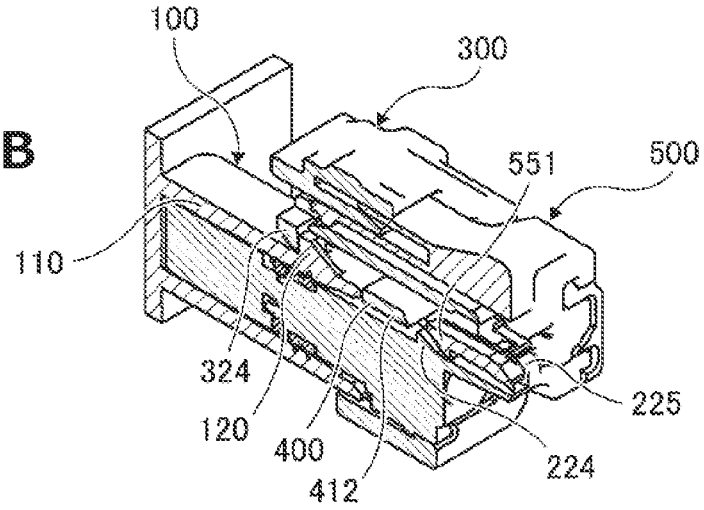
FIG. 15B is a cross-sectional perspective view corresponding to FIG. 15A.
Figure 16A:
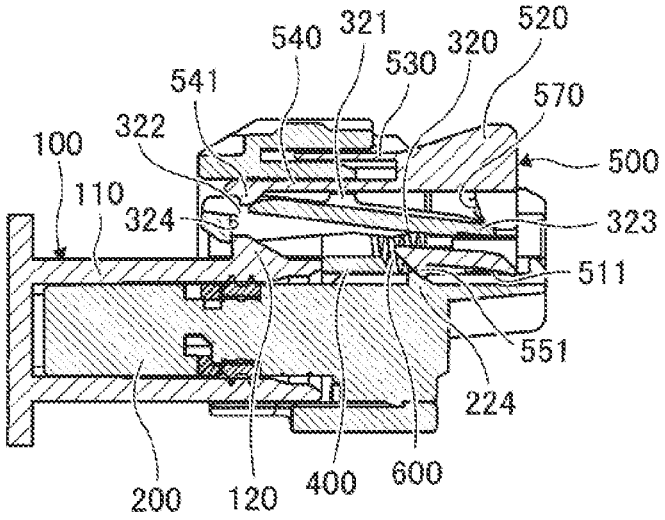
FIG. 16A is a cross-sectional view illustrating a state of the male connector assembly and the female connector assembly in which the CPA member is moved forward to release the mating state.
Figure 16B:
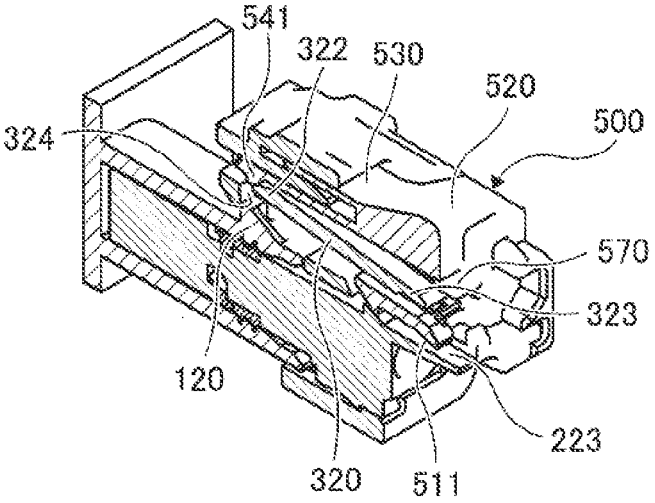
FIG. 16B is a cross-sectional perspective view corresponding to FIG. 16A.

In the mating state illustrated in FIGS. 15A and 15B, next, the CPA member 500 is moved forward (in the mating direction) as illustrated in FIGS. 16A and 16B. At this time, an operator moves the CPA member 500 in the front direction by pinching the operation button 520 of the CPA member 500 with his/her fingers and the like. At this time, the guiding plate 530 of the CPA member 500 moves in the upper plate inner slot 311C of the hood housing 300, and the base bottom surface 511 of the CPA member 500 moves on the inter-rail groove 223 of the female connector housing 200, and the spring receiving portion bottom surface 563 of the CPA member 500 moves on the expansion portion 222 on the outside of the rail 221 of the female connector housing 200. Therefore, the CPA member 500 is only allowed to move in the back-and-forth direction, and the movement in the up-and-down direction is limited. The each spring member 600 is compressed between the slider 400 and the CPA member 500, which are immovably pressed by the male housing 110, and the spring force accumulates.

When the CPA member 500 is moved to the front direction, the inclined surface 570 provided on the base 510 contacts the working end 323 of the arm 320 of the hood housing 300 and pushes the working end 323 downward. On the other hand, the arm pressing projection 541 of the upper side extension plate 540 of the CPA member 500 moves to the front side of the front end portion 322 of the arm 320, and the front end portion 322 of the arm 320 is in a state capable of moving upward. Therefore, the arm 320 swivels clockwise on the leg portion 321 as the fulcrum, and the front end portion 322 of the arm 320 moves upward. By the swiveling movement of the arm 320, the locking step 324 of the front end portion 322 is released from the locking with the male side locking projection 120 of the male housing 110.

Figure 17A:
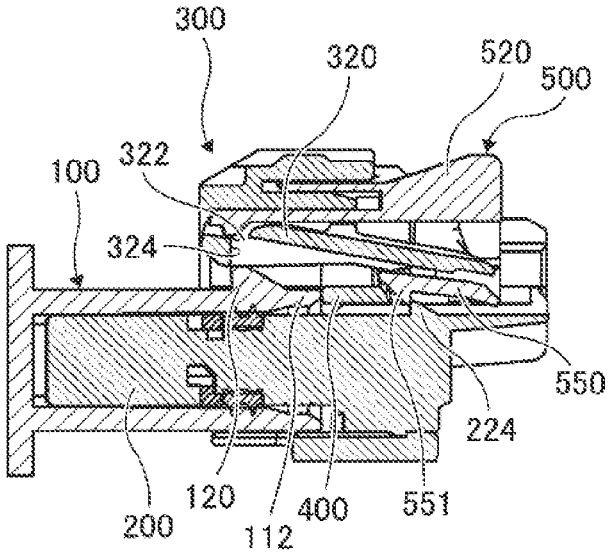
FIG. 17A is a cross-sectional view illustrating a state of the male connector assembly and the female connector assembly just before releasing mating in which the CPA member is further moved forward from the state in FIG. 16A.
Figure 17B:
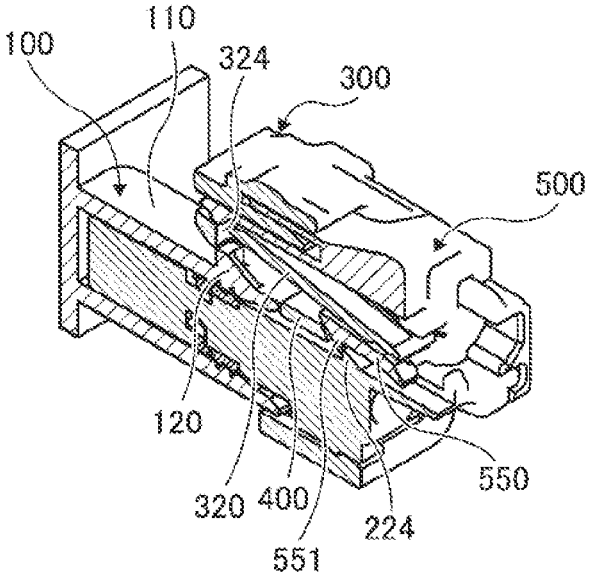
FIG. 17B is a cross-sectional perspective view corresponding to FIG. 17A.

At this time, as illustrated in FIGS. 17A and 17B, the CPA side locking projection 551 of the lower side extension plate 550 of the CPA member 500 gets over the female side locking projection 224 of the female connector housing 200 from the rear side to be locked again, resulting in a state that the CPA member 500 cannot move rearward. Also, since the locking step 324 of the front end portion 322 of the arm 320 of the hood housing 300 is released from the locking with the male side locking projection 120 of the male housing 110 while the movement of the CPA member 500 to the rear is restricted, the slider 400 is pushed forward by the spring force accumulated in the spring member 600, the contact surface 411 of the slider 400 pushes the rear end surface 112 of the male housing 110 forward, and the connector come to be a non-mating state at once. Therefore, the fit between the male housing 110 and the female connector housing 200 can be released.

What is claimed is:

1. A connector locking mechanism comprising:

a housing including: a mating opening configured to accept a mating connector; and an arm configured to extend substantially parallel to an extending direction of the mating opening, connected via a leg portion of the arm as a fulcrum, configured to include an arm locking member for locking capable of being locked with a locking projection of the mating connector on one side, and configured to include a working end on another side, and a locking member built in the housing movably between a non-mating position and a complete mating position, configured to include a plate member having a front end and a base end, an arm pressing projection provided at the front end of the plate member at a position corresponding to the one side of the arm, and configured to include an inclined surface provided at the base end of the plate member at a position corresponding to another side of the arm, wherein when mating: the mating connector is inserted into the mating opening; the locking member is moved to the complete mating position by the mating connector; the one side of the arm swivels on the leg portion as the fulcrum so as to approach the mating connector by the arm pressing projection; and the arm locking member is locked with the locking projection, and when releasing mating: by moving the locking member toward the non-mating position, the inclined surface comes into contact with the working end of the arm so that the one side of the arm swivels on the leg portion as the fulcrum so as to move away from a housing of the mating connector; and the arm locking member is released from the locking projection of the mating connector.

2. The connector locking mechanism according to claim 1, further comprising:

a slider; and a spring member configured to be interposed between the slider and the locking member, wherein the housing accepting the mating connector includes a locking projection for CPA (connector position assurance) locking, the locking member includes a CPA side locking projection that is locked with the locking projection for CPA locking when the locking member is located at the non-mating position, and the slider includes a contact surface that is pressed against the mating connector and a pressing portion that presses the CPA side locking projection, when the mating connector is inserted into the mating opening, the mating connector presses the contact surface of the slider located at the non-mating position so that the pressing portion presses the CPA side locking projection, the locking projection for CPA locking is released from the CPA side locking projection, and the locking member is moved to the complete mating position by urging force of the spring member.

3. The connector locking mechanism according to claim 2, wherein a plurality of the spring members are arranged in parallel between the slider and the locking member, and the slider includes a plurality of spring receiving portions each accepting one end side of the plurality of spring members.

4. The connector locking mechanism according to claim 1, wherein the locking member includes a base on which the inclined surface is formed, and the arm pressing projection extends from a central portion in a width direction orthogonal to the mating direction of the base to the mating direction.

5. The connector locking mechanism according to claim 1, wherein the housing accepting the mating connector includes a rail that guides the locking member to move, and a base of the locking member moves on the rail between the non-mating position and the complete mating position.

* * * * *